US010726770B2

(12) United States Patent
Tamura

(10) Patent No.: US 10,726,770 B2
(45) Date of Patent: Jul. 28, 2020

(54) DISPLAY APPARATUS AND ELECTRONIC APPARATUS

(71) Applicant: SEIKO EPSON CORPORATION, Tokyo (JP)

(72) Inventor: Tsuyoshi Tamura, Hara-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/909,361

(22) Filed: Mar. 1, 2018

(65) Prior Publication Data

US 2018/0261150 A1 Sep. 13, 2018

(30) Foreign Application Priority Data

Mar. 8, 2017 (JP) ..... 2017-043494

(51) Int. Cl.
*G09G 3/32* (2016.01)
*G09G 3/20* (2006.01)

(52) U.S. Cl.
CPC ..... *G09G 3/32* (2013.01); *G09G 3/20* (2013.01); *G09G 3/2074* (2013.01); *G09G 2310/027* (2013.01); *G09G 2310/0213* (2013.01); *G09G 2310/0267* (2013.01); *G09G 2310/0291* (2013.01); *G09G 2310/0297* (2013.01); *G09G 2330/021* (2013.01); *G09G 2330/023* (2013.01); *G09G 2330/028* (2013.01)

(58) Field of Classification Search
CPC ..... G09G 3/3648; G09G 2320/0261; G09G 2310/061; G09G 3/3614; G09G 3/3406; G09G 2320/0238; G09G 2300/0866; G09G 3/3291; G09G 2310/027; G09G 3/3275; G11C 19/28
See application file for complete search history.

(56) References Cited

U.S. PATENT DOCUMENTS

2002/0175887 A1 11/2002 Yamazaki
2003/0197472 A1 10/2003 Kanauchi et al.
2007/0063959 A1 3/2007 Iwabuchi et al.
2009/0219240 A1* 9/2009 Yamaguchi ..... G09G 3/3688 345/88
2010/0128019 A1 5/2010 Harada
2012/0001950 A1 1/2012 Kim
2014/0028640 A1* 1/2014 Kimura ..... G09G 3/3614 345/204

(Continued)

FOREIGN PATENT DOCUMENTS

JP 2003-316315 A 11/2003
JP 2004-004837 A 1/2004

(Continued)

*Primary Examiner* — Gerald Johnson
(74) *Attorney, Agent, or Firm* — Oliff PLC

(57) ABSTRACT

A display apparatus includes a pixel circuit array, a scanner-drive type drive circuit configured to sequentially drive each of blocks of data line groups in the pixel circuit array, and a control circuit configured to control the drive circuit. The control circuit receives determination information for determining whether or not a display line corresponding to display data is a black display line. Based on the determination information, the control circuit sets amplifier circuits included in the drive circuit to an operation off state or a low power consumption state during a period in which the black display line is driven.

18 Claims, 10 Drawing Sheets

(56) References Cited

U.S. PATENT DOCUMENTS

| | | | | |
|---|---|---|---|---|
| 2014/0285405 | A1 | 9/2014 | Nomura | |
| 2015/0356898 | A1* | 12/2015 | Jeon | H05K 999/99 345/690 |
| 2016/0358527 | A1* | 12/2016 | Bae | G09G 5/006 |
| 2017/0160655 | A1 | 6/2017 | Adachi et al. | |
| 2017/0169755 | A1 | 6/2017 | Tamura | |
| 2017/0244970 | A1 | 8/2017 | Tamura et al. | |
| 2017/0249885 | A1 | 8/2017 | Tamura | |

FOREIGN PATENT DOCUMENTS

| | | | |
|---|---|---|---|
| JP | 2007-058202 | A | 3/2007 |
| JP | 2010-128014 | A | 6/2010 |
| JP | 2011-013275 | A | 1/2011 |
| JP | 2012-014137 | A | 1/2012 |
| JP | 2014-186083 | A | 10/2014 |
| JP | 2016-139079 | A | 8/2016 |
| JP | 2017-107004 | A | 6/2017 |
| JP | 2017-111236 | A | 6/2017 |
| JP | 2017-146535 | A | 8/2017 |
| JP | 2017-151284 | A | 8/2017 |

* cited by examiner

DISPLAY APPARATUS AND ELECTRONIC APPARATUS

BACKGROUND

1. Technical Field

The present invention relates to display apparatuses and electronic apparatuses.

2. Related Art

Typical display apparatuses include a display apparatus having integrated panel and driver, for example, disclosed in JP-A-2014-186083. This display apparatus includes data latch circuits, line latch circuits, and digital-to-analog (D/A) conversion circuits.

To lower the power consumption in such display apparatuses, techniques are disclosed in JP-A-2010-128014, JP-A-2007-058202, JP-A-2004-004837, and JP-A-2003-316315. According to JP-A-2010-128014, among gate lines, gate lines from a gate line specified by a partial start address to a gate line specified by a partial end address are driven to implement partial displaying. According to JP-A-2007-058202, in partial displaying, while pixels in a non-display area are being selected, a signal line drive circuit is stopped. According to JP-A-2004-004837, a voltage applied to scanning electrodes is fixed to a non-selective voltage, and the level of a voltage applied to signal electrodes is fixed to a level similar to that of a voltage applied in a full-screen-on mode or a full-screen-off mode in at least a predetermined period. According to JP-A-2003-316315, while a scanning driver is scanning lines in a non-display area, driving of a data driver is stopped.

In the display apparatus according to JP-A-2014-186083, the continuous operation of the circuits consumes electric power. To lower such power consumption in the display apparatuses, if the display lines are black display lines, amplifier circuits may be turned off during a period in which the display lines are driven. In a scanner drive system for sequentially driving each block of data line groups in a pixel circuit array, however, display data of one line is not latched and thus the display apparatus cannot determine whether or not the display line is a black line.

SUMMARY

According to some aspects of the invention, display apparatuses and electronic apparatuses that have achieved lower power consumption in a scanner drive system can be provided.

According to an aspect of the invention, a display apparatus include a pixel circuit array, a scanner-drive type drive circuit configured to sequentially drive each of blocks of data line groups in the pixel circuit array, and a control circuit configured to control the drive circuit. The control circuit receives determination information for determining whether or not a display line corresponding to display data is a black display line, and based on the determination information, sets amplifier circuits included in the drive circuit to an operation off state or a low power consumption state during a period in which the black display line is driven.

According to this aspect of the invention, determination information for determining whether or not a display line corresponding to display data is a black display line is received, and based on the determination information, amplifier circuits included in the drive circuit are set to an operation off state or a low power consumption state during a period in which the black display line is driven. With this configuration, in the scanner drive system in which the display apparatus does not latch display data of one line, a black display line can be detected and thereby the power consumption of the display apparatus can be reduced.

In this case, the control circuit may receive the determination information included in header information of the display data corresponding to the display line.

With this configuration, for each display line, the display data with added header information can be received. Accordingly, whether or not the display line is a black display line can be determined by simply referring to the header information, and thereby the process for detecting a black display line can be simplified.

In this case, if the control circuit determines that the display line corresponding to the header information is the black display line based on the determination information included in the header information, the control circuit may set the amplifier circuits to the operation off state or the low power consumption state during the period in which the display line is driven.

With this configuration, the determination information included in the header information can be extracted and whether or not the display line corresponding to the header information is a black display line can be determined based on the extracted determination information. If the display line is a black display line, the amplifier circuits can be set to the operation off state or the low power consumption state.

In this case, the control circuit may receive a command indicating a start line and an end line of a black display area as the determination information.

With this configuration, by receiving a command indicating a start line and an end line of a black display area, the information about the start line and the end line can be obtained. Based on the information about the start line and the end line, the black display line can be detected.

In this case, the control circuit may set the amplifier circuits to the operation off state or the low power consumption state during the period in which the display lines from the start line to the end lines are driven.

With this configuration, during the period in which the display lines constituting the black display area are driven, the current consumption of the amplifier circuits can be reduced.

In this case, the drive circuit may include the amplifier circuits, a digital-to-analog (D/A) conversion circuit that outputs a data voltage to the amplifier circuits, a first latch circuit that outputs display data to the D/A conversion circuit, and a second latch circuit that latches the received display data and outputs the data to the first latch circuit.

In the scanner drive system, it is not necessary to latch display data of one line into the first latch circuit and the second latch circuit, and thus it is impossible to monitor the display data of one line and determine whether or not the display line is a black display line. To solve the problem, the determination information is received from an external device and whether or not the display line is a black display line can be determined.

In this case, in a k-th period, where k is an integer one or more and m or less, in a first to m-th periods, where m is an integer two or more, in a horizontal scanning period, the first latch circuit may latch first data of n pixels, where n is and integer two or more, corresponding to the block, and the second latch circuit may latch second data, which is a next data of the first data, of n pixels corresponding to the block.

In the scanner drive system, only the display data of one block (n pixels) is latched and it is not possible to determine whether or not the display line is a black display line in accordance with the latched display data. To solve the problem, the determination information is received from an external device and whether or not the display line is a black display line can be determined.

In this case, the drive circuit may drive the n pixels corresponding to the block in accordance with the first data during the k-th period.

In such a manner, the first latch circuit sequentially latches the display data of n pixels and n pixels in the display line are driven at a time based on the display data of n pixels. Accordingly, the first latch circuit has to store only the display data of n pixels at a time. Even in such a scanner drive system, it is possible to determine whether or not the display line is a black display line.

In this case, the pixel circuit included in the pixel circuit array may include a transistor for supplying an electric current to a pixel, and the control circuit may turn off the transistor in the pixel circuit corresponding to the black display line during the period in which the black display line is driven.

With this configuration, the transistor supplies no electric current to the pixel corresponding to the black display line and thereby the pixel can be displayed in black (displayed in accordance with the zero data).

In this case, the display apparatus may include a gradation voltage generation circuit configured to supply gradation voltages to the drive circuit. The control circuit may set the gradation voltage generation circuit to an operation off state or a low power consumption state during the period in which the black display line is driven.

With this configuration, during the period in which the black display line is driven, not only the current consumption of the amplifier circuits but also the current consumption of the gradation voltage generation circuit can be reduced.

According to another aspect of the invention, an electronic apparatus includes any one of the above-described display apparatuses.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described in detail with reference to the accompanying drawings. The embodiments described below do not unduly limit the scope of the invention defined in the claims, and not all of the configurations and structures described in the embodiments are essential to the solution of the invention.

1. Comparative Example

Figure 1:
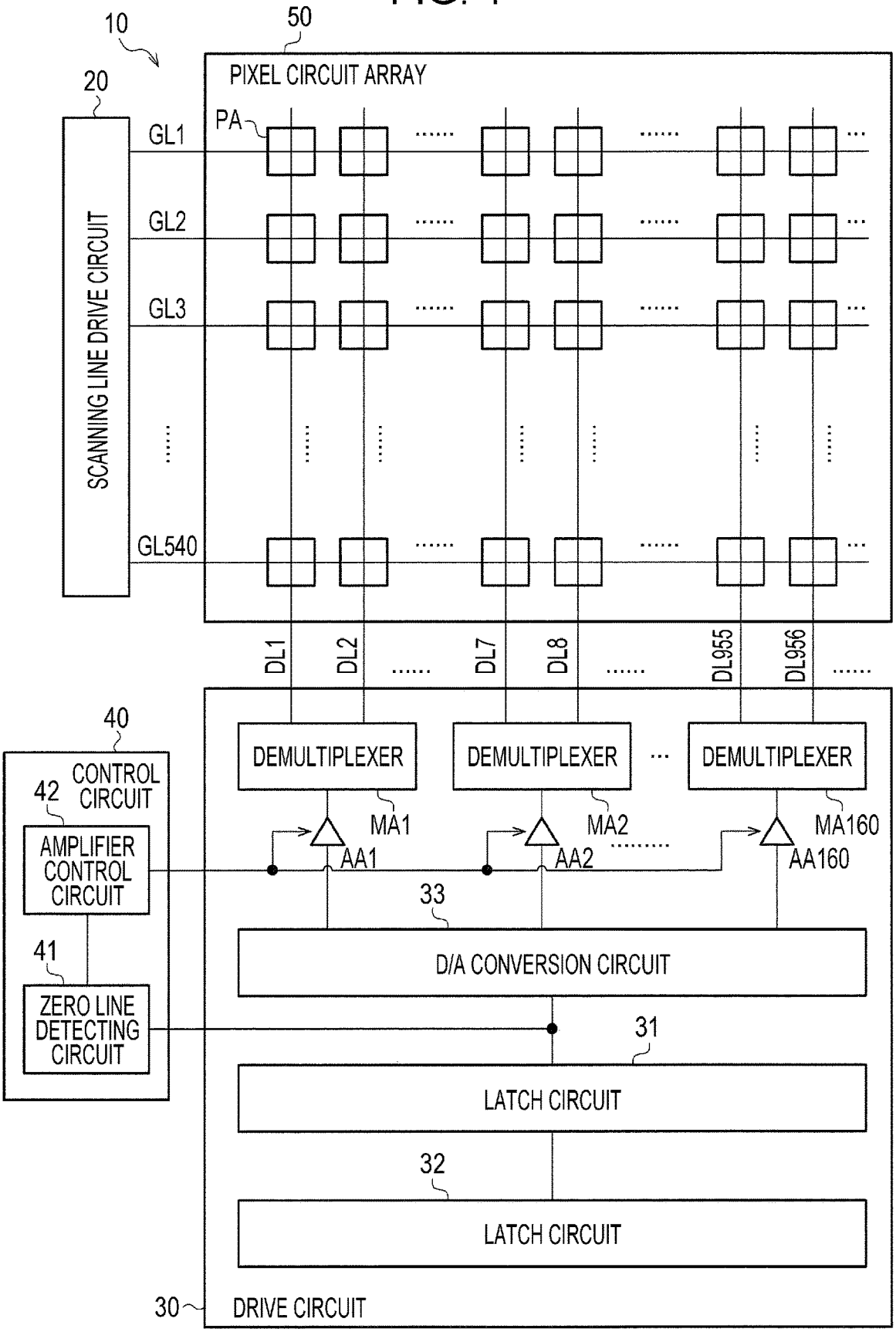
FIG. 1 is a comparative example of a display apparatus.

FIG. 1 is a comparative example of a display apparatus. In this comparative example, pixels are driven by demultiplexing driving and an amplifier circuit is turned off while black display lines are driven. Specifically, a display apparatus 10 includes a scanning line drive circuit 20, a drive circuit (data line drive circuit) 30, a control circuit 40, and a pixel circuit array (pixel array) 50.

The pixel circuit array 50 includes 540 scanning lines GL1 to GL540, 960 data lines DL1 to DL960, and pixel circuits (pixels) PA that are arranged in a matrix of 540 rows and 960 columns. In FIG. 1, a reference numeral PA is given only to the pixel at the first row and the first column and the reference numerals to the other pixels are omitted. To a pixel circuit PA at an i-th row and a j-th column, a scanning line GLi and a data line DLj are connected, where i is an integer between 1 and 540 inclusive, and j is an integer between 1 to 960 inclusive.

The scanning line drive circuit 20 sequentially drives (selects) the scanning lines GL1 to GL540 one by one. For example, when the scanning line drive circuit 20 drives the scanning line GLi, the drive circuit 30 applies a data voltage to the pixels of the i-th row that is connected to the scanning line GLi.

The drive circuit 30 includes latch circuits 31 and 32, a D/A conversion circuit 33, amplifier circuits AA1 to AA160, and demultiplexers MA1 to MA160. The latch circuit 32 latches display data of one line (one display line) that has been transmitted from an external device (for example, a display controller) of the display apparatus 10. One line consists of pixels of one row that are connected to one scanning line. The latch circuit 31 latches the display data of one line that has been latched by the latch circuit 32 and outputs the latched display data in the time-division manner (by multiplexing) every six pixels. The D/A conversion circuit 33 performs D/A conversion on the time-division display data and outputs a time-division data voltage. Each of the amplifier circuits AA1 to AA160 amplifies the time-division data voltage. Each of the demultiplexers MA1 to MA160 sequentially selects six data lines in a time-division manner and distributes (multiplexes) the time-division data voltage from the amplifier circuit to the six data lines. For example, the demultiplexer MA1 sequentially selects the data lines DL1, DL2, DL3, DL4, DL5, and DL6 in a time-division manner in one horizontal scanning period.

The control circuit 40 includes a zero-line detecting circuit 41 and an amplifier control circuit 42. The zero-line detecting circuit 41 detects a black display line. Specifically, when all display data of one line that has been latched by the latch circuit 31 is zero data, the zero-line detecting circuit 41 determines that the display line is a black display line. When the zero-line detecting circuit 41 detects a black display line, the amplifier control circuit 42 sets the amplifier circuits AA1 to AA160 to an operation-off state or a low power consumption state while the display line is being driven (for example, during a horizontal scanning period corresponding to the display line).

As described above, in the demultiplex drive system, the latch circuit 31 and the latch circuit 32 latch the display data of one line and thus a black display line can be detected in the display apparatus 10. By using the detection result, the amplifier circuits AA1 to AA160 can be set to the operation-off state or the low power consumption to lower the power consumption of the display apparatus 10.

The demultiplex drive system is suitable for driving high definition panels and high-frame-rate driving; however, many amplifier circuits are necessary. On the other hand, the scanner drive system requires fewer amplifier circuits than the demultiplex drive system, and thus the size of the circuit (chip area) can be reduced. The scanner drive system, however, latches only the display data of pixels driven at once (the same number of pixels as the number of the amplifier circuits) and does not latch the display data of one line. Accordingly, in the scanner drive system, it is difficult to detect a black display line to lower the power consumption of the display apparatus.

2. First Example Configuration

Figure 2:
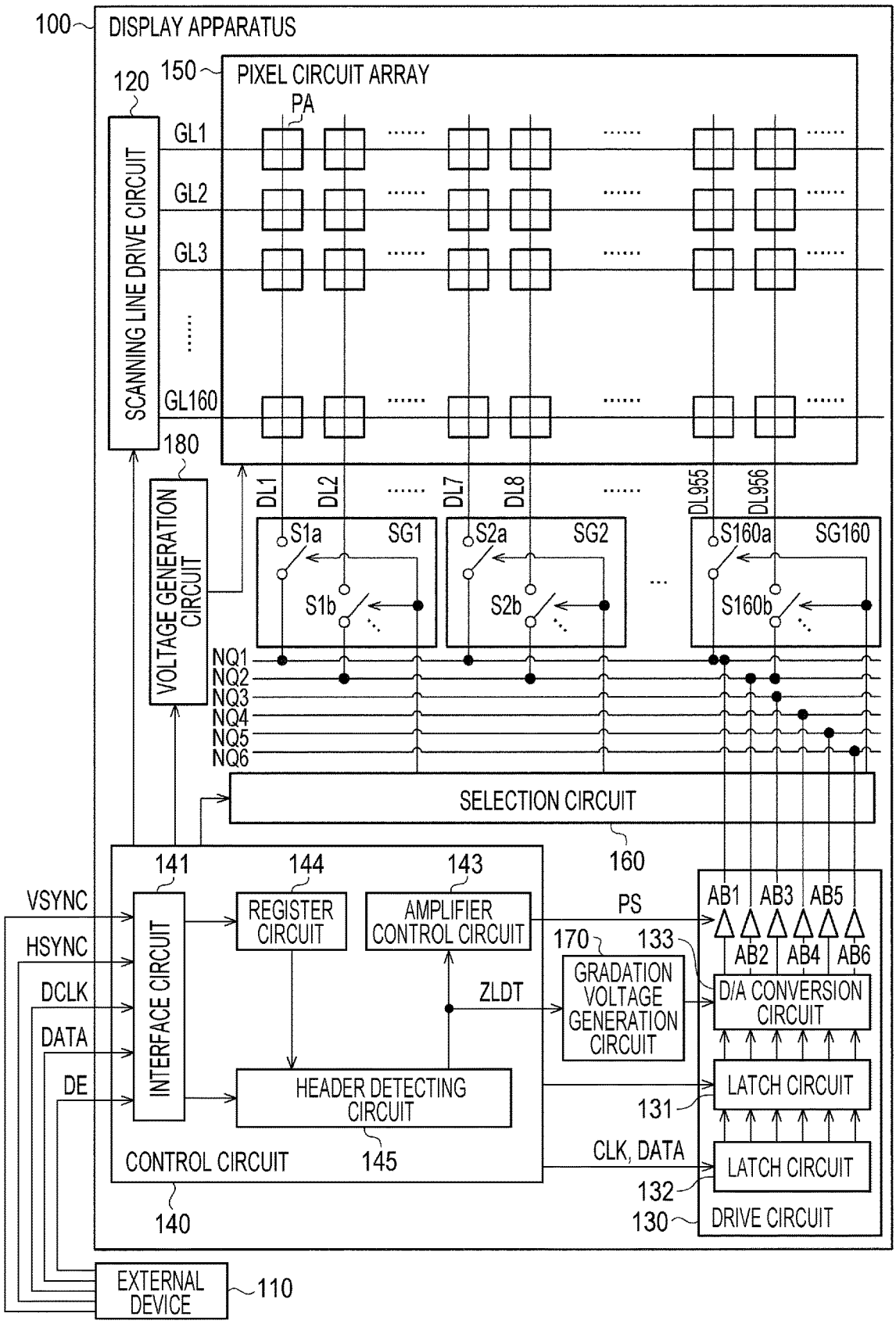
FIG. 2 illustrates a first configuration of a display apparatus according to an embodiment.

FIG. 2 illustrates a first configuration of the display apparatus according to the embodiment for solving the above-mentioned problems. A display apparatus 100 includes a scanning line drive circuit (gate line drive circuit) 120, a drive circuit (data line drive circuit) 130, a control circuit (display control circuit) 140, a pixel circuit array 150, a selection circuit 160, a gradation voltage generation circuit 170, a voltage generation circuit 180, and selectors SG1 to SG160. Note that this embodiment is not limited to the configuration illustrated in FIG. 2, and various modifications may be made, for example, a part of the components may be omitted or other components may be added.

The configurations and operations of the pixel circuit array 150 and the scanning line drive circuit 120 are similar to those of the pixel circuit array 50 and the scanning line drive circuit 20 in FIG. 1 respectively, and accordingly, their descriptions are omitted. In the following description, an example array in which 540 rows and 960 columns of pixel circuits PA are arrayed on the pixel circuit array 150 will be described. However, the embodiment is not limited to this example, and for example, N rows and M columns of pixel circuits PA may be provided, where N and M are integers greater than or equal to two.

The drive circuit 130 includes latch circuits 131 and 132, a D/A conversion circuit 133, and amplifier circuits AB1 to AB6. In this embodiment, six amplifier circuits are provided as an example. However, the invention is not limited to this example and n amplifier circuits may be provided, where n is an integer greater than or equal to two.

The latch circuit 132 latches display data DATA that has been transmitted from an external device (for example, a display controller) 110 of the display apparatus 100 via the control circuit 140. In this operation, the latch circuit 132 latches the display data of six pixels that is equal in number of the amplifier circuits AB 1 to AB6. The latch circuit 132 sequentially obtains the display data DATA, which is serial data, in accordance with a clock signal CLK to latch the display data of the six pixels. The latch circuit 131 latches the display data of the six pixels at the timing the latch circuit 132 has obtained the display data of next six pixels.

The D/A conversion circuit 133 performs a digital-to-analog conversion (in parallel) on the display data of the six pixels that has been latched by the latch circuit 131 to obtain data voltages. Each of the amplifier circuits AB1 to AB6 amplifies the data voltage of the one pixel. An amplifier circuit ABs outputs the amplified data voltage to an output node NQs, where s is an integer from 1 to 6 inclusive.

Each of the selectors SG1 to SG160 includes six switching elements that are disposed between the output nodes NQ1 to NQ6 and six data lines. For example, the selector SG1 includes switching elements S1*a*, S1*b*, S1*c*, S1*d*, S1*e*, and S1*f* that are disposed between the output nodes NQ1, NQ2, NQ3, NQ4, NQ5, and NQ6 and data lines DL1, DL2, DL3, DL4, DL5, and DL6. The selector SG2 includes switching elements S2*a*, S2*b*, S2*c*, S2*d*, S2*e*, and S2*f* that are disposed between the output nodes NQ1, NQ2, NQ3, NQ4, NQ5, and NQ6 and data lines DL7, DL8, DL9, DL10, DL11, and DL12. The switching element is, for example, a transfer gate including a metal oxide semiconductor (MOS) transistor.

The selection circuit 160 selects the selectors SG1 to SG160 sequentially from the selector SG1 in a horizontal scanning period. The switching elements of the selected selector are turned on whereas the switching elements of the unselected selector are turned off. Specifically, after a horizontal scanning period has been started, first, the selector SG1 is selected and then the selection circuit 160 turns on the switching elements S1*a* to S1*f*. The output nodes NQ1 to NQ6 are connected to the data lines DL1 to DL6 and the data voltages that have been output from the amplifier circuits AB1 to AB6 are supplied to the data lines DL1 to DL6. Then, the selector SG2 is selected and the selection circuit 160 turns on the switching elements S2*a* to S2*f*. The output nodes NQ1 to NQ6 are connected to the data lines DL7 to DL12 and the data voltages that have been output from the amplifier circuits AB1 to AB6 are supplied to the data lines DL7 to DL12. This operation is sequentially repeated to the selector SG160. With these operations, the scanner driving in which the data lines DL1 to DL960 are sequentially driven every six lines (every block of six lines) is implemented.

The voltage generation circuit 180 generates a voltage to be used in the pixel circuit array 150. For example, the voltage generation circuit 180 generates a voltage Vorst for resetting a voltage at one end of a pixel (light emitting diode) and supplies the voltage to each pixel circuit PA in the pixel circuit array 150.

The gradation voltage generation circuit 170 is, for example, a ladder resistance circuit, and generates a plurality of reference voltages (gradation voltages) by dividing the voltage between a high-potential power-supply voltage and a low-potential power-supply voltage. The D/A conversion circuit 133 selects, from the reference voltages, a reference voltage corresponding to the display data and outputs the selected reference voltage as a data voltage.

The control circuit 140 controls each components in the display apparatus 100. For example, the control circuit 140 performs display control (the control of pixel drive timing) and operation mode setting. The control circuit 140 includes an interface circuit 141, an amplifier control circuit 143, a register circuit (register) 144, and a header detecting circuit 145.

The interface circuit 141 communicates with the external device 110 and the display apparatus 100. For example, the interface circuit 141 receives, from an external device, a vertical synchronizing signal VSYNC, a horizontal synchronization signal HSYNC, a pixel clock DCLK, display data DATA, and a data enable signal DE. The register circuit 144 can be accessed from the external device 110 via the interface circuit 141 by communication such as a Serial Peripheral Interface (SPI) or an Inter-Integrated Circuit (I2C). The register circuit 144 stores setting information for setting operations of the display apparatus 100 and other information.

The header detecting circuit 145 detects (extracts) header information that has been added to display data and analyzes (decodes) the header information. If the header information indicates a black display line, the header detecting circuit 145 changes the detection signal ZLDT from inactive (a first logic level, for example, a low level) to active (a second logic level, for example, a high level). For example, the register circuit 144 stores a code corresponding to black display line and the header detecting circuit 145 compares the code with the header information, and if the code and the header information correspond with each other, the header detecting circuit 145 determines that the header information indicates a black display line.

The amplifier control circuit 143 controls the amplifier circuits AB1 to AB6 in accordance with the detection signal ZLDT from the header detecting circuit 145. Specifically, if the detection signal ZLDT is active, the amplifier control circuit 143 sets the control signal PS to active (the second logic level, for example, the high level) to set the amplifier circuits AB1 to AB6 to an operation off state or a low power consumption state. On the other hand, if the detection signal ZLDT is inactive, the amplifier control circuit 143 sets the control signal PS to inactive (the first logic level, for example, the low level) so as not to set the amplifier circuits AB1 to AB6 to the operation off state or a low power consumption state (sets to an operating state).

The detection signal ZLDT from the header detecting circuit 145 is also input to the gradation voltage generation circuit 170. If the detection signal ZLDT is active, the gradation voltage generation circuit 170 is set to the operation off state or the low power consumption state. On the other hand, if the detection signal ZLDT is inactive, the gradation voltage generation circuit 170 is not set to the operation off state or the low power consumption state (set to the operating state).

Figure 3:
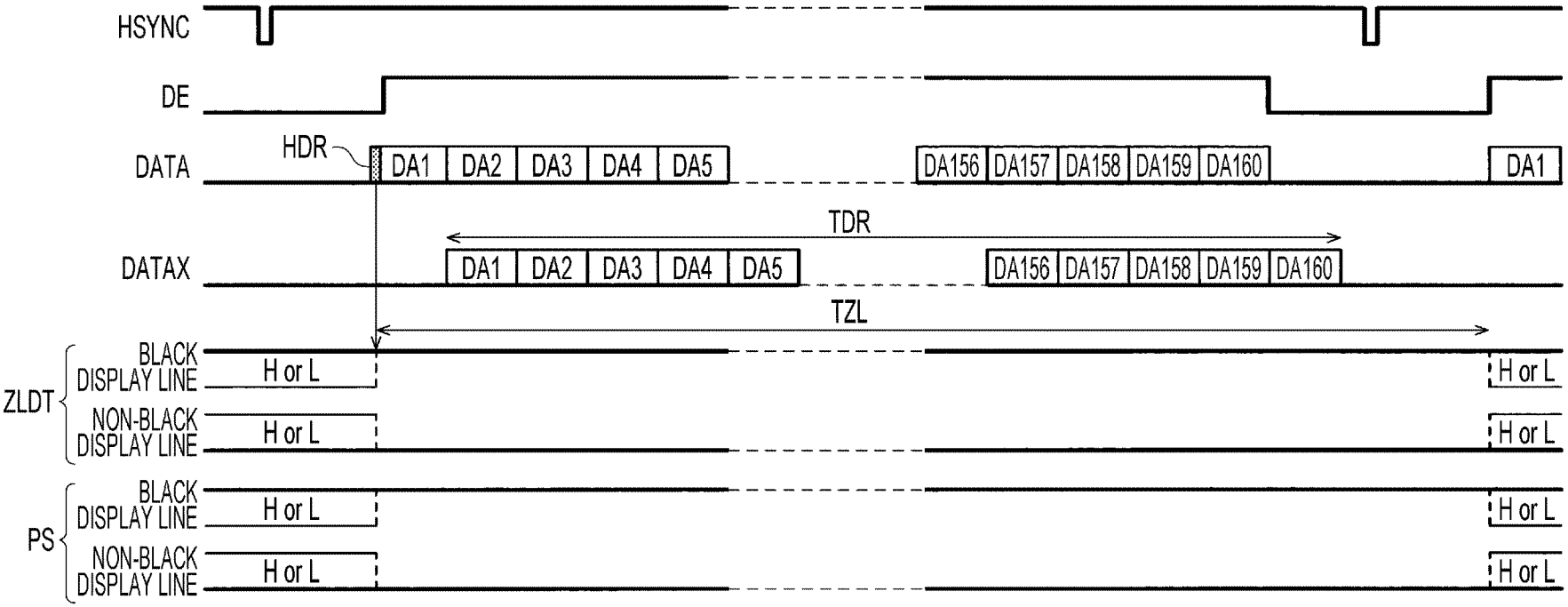
FIG. 3 is an operation timing chart of the display apparatus in the first configuration.

FIG. 3 is an operation timing chart of the display apparatus in the first configuration.

As illustrated in FIG. 3, after the horizontal synchronization signal HSYNC has fallen, the data enable signal DE becomes active (high level) at a predetermined timing. While the data enable signal DE is active, the display data DA1 to DA160 (display data to be displayed with pixels) is transferred from the external device 110 to the display apparatus 100. Each of the display data DA1 to DA160 is display data of six pixels (pixels that is equal in number of the amplifier circuits AB1 to AB6). First, the display data DA1 is latched by the latch circuit 132 and the display data DA1 is transferred to the latch circuit 131. While the display data DA1 is latched by the latch circuit 131, the next display data DA2 is latched by the latch circuit 132 and the display data DA2 is transferred to the latch circuit 132. This operation is repeated to the display data DA160.

Driving of data lines by the amplifier circuit AB1 to AB6 is performed while the latch circuit 131 is latching the display data. For example, while the latch circuit 131 is latching the display data DA1, data voltages corresponding to the display data DA1 are output to the data lines DL1 to DL6. Then, while the latch circuit 131 is latching the display data DA2, data voltages corresponding to the display data DA2 are output to the data lines DL7 to DL12. This operation is repeated to the display data DA160 and thereby writing of the data of one line to one display line is performed.

The header information HDR is added to a top (in front of the display data DA1 to DA160) of the display data DATA. For example, the header information HDR is input before the data enable signal DE becomes active. The control timing for displaying is controlled in accordance with pixel clocks; at which clock timing after a horizontal synchronization signal HSYNC has fallen the header information HDR is to be input is determined in advance. In accordance with the predetermined timing, the external device 110 transmits the header information HDR, and the header detecting circuit 145 detects the header information HDR.

If the display data DA1 to DA160 is zero data (the all display data of the pixels is zero), the external device 110 transmits, for example, header information "FAFh", where "h" indicates that the numerical value is a hexadecimal digit. If the display data DA1 to DA160 is non-zero data, the external device 110 transmits, for example, header information "F0Fh". If the header information HDR is "FAFh", the header detecting circuit 145 outputs a detection signal ZLDT of a high level (active), and if the header information HDR is "F0Fh", the header detecting circuit 145 outputs a detection signal ZLDT of a low level (inactive). If the detection signal ZLDT indicates the high level, the amplifier control circuit 143 outputs a high-level (active) control signal PS to the amplifier circuits AB1 to AB6. If the detection signal ZLDT indicates the low level, the amplifier control circuit 143 outputs a low-level (inactive) control signal PS to the amplifier circuits AB1 to AB6.

According to the above-described embodiment, the display apparatus 100 includes the pixel circuit array 150, the drive circuit 130, which is the scanner-driving type drive circuit that sequentially drives each of the blocks of the data line groups (data line DL1 to DL960) of the pixel circuit array 150, and the control circuit 140 that controls the drive circuit 130. The control circuit 140 receives determination information for determining whether or not display lines corresponding to the display data DATA (DA1 to DA160) are black display lines. The control circuit 140 sets the amplifier circuits AB1 to AB6 in the drive circuit 130 to an operation off state or a low power consumption state based on the determination information during the period in which a black display line is driven.

Specifically, the block of the data line group includes a predetermined number of (equal to the number of the amplifier circuits) arrayed data lines. The expression "to sequentially drive each of the blocks of data line groups" means that one block is driven and then a next block (for example, an adjacent block) is driven and further another next block (for example, another adjacent block) is driven, and this operation is sequentially repeated.

The black display line is a display line that displays no image and character; for example, the display data of pixels in a black display line is all zero data. Here, "black" means no image and character are displayed and the color of the display line that is actually being displayed is not always black. For example, in a see-through head-mounted display 200, which will be described below with reference to FIG. 8, black display lines display no images and characters, enabling the user to see the external scenery through the display.

The determination information is the header information HDR in the first configuration; however, it is not limited to this example. For example, the determination information may be information that is input from the external device 110 of the display apparatus 11, and any information can be used as long as the information indicates whether or not the display line is a block display line. For example, in a second configuration described below, the determination information is a command that indicates the start line and the end line of a black display area.

The drive period of a display line (black display line) is a period TDR in FIG. 3. The period is from the start of driving of the first display data DA1 to the end of driving of the last display data DA160 in a horizontal scanning period. The amplifier circuits AB1 to AB6 are set to the operation off state or the low power consumption state during a period equal to the period TDR or a period including the period TDR, for example, the period TZL in FIG. 3.

The operation off state of the amplifier circuits is a state where the operation of the amplifier circuit is turned off (disabled), for example, a state where the amplifier circuit amplifies no input signal, a state where a bias current of the amplifier is turned off, or a state where output of the amplifier circuit is turned off (set to high impedance). The low power consumption state of the amplifier circuit is a state where power consumption is lower than that in normal operation of the amplifier circuit, for example, a state where a bias current of the amplifier circuit is reduced, or a part of a bias current of the amplifier circuit is turned off.

According to this embodiment, the determination information for determining whether or not a display line corresponding to display data is a black display line can be received, and based on the determination information, the amplifier circuits can be set to the operation off state or the low power consumption state during the period in which the black display line is driven. With this configuration, in the scanner drive system in which the display apparatus latches no display data corresponding to one line, a black display line can be detected by receiving the determination information transmitted from the external device 110, and thereby the power consumption of the display apparatus can be reduced.

In this embodiment, the control circuit 140 receives the determination information included in the header information HDR of the display data corresponding to a display line.

The header information HDR is added as a header of the display data DA1 to DA160 of one line. The header information HDR may include only the determination information or may include the determination information and other information.

With this configuration, for each display line, the display data with the added header information can be received. Accordingly, whether or not a display line is a black display line can be determined (for example, without counting the number of the scanning lines or comparing the scanning lines) by simply referring to the header information, and thereby the process for detecting a black display line can be simplified.

Furthermore, in this embodiment, if the control circuit 140 determines that a display line (a display line corresponding to the display data to which the header information HDR has been added) corresponding to the header information HDR is a black display line based on the determination information included in the header information HDR, the amplifier circuits AB1 to AB6 are set to the operation off state or the low power consumption state during the drive period TDR (TZL) of the display line.

With this configuration, the determination information included in the header information HDR can be extracted, whether or not the display line corresponding to the header information HDR is a black display line can be determined based on the extracted determination information, and if the display line is a black display line, the amplifier circuits AB1 to AB6 can be set to the operation off state or the low power consumption state.

In this embodiment, the drive circuit 130 includes the amplifier circuits AB1 to AB6, the D/A conversion circuit 133, which outputs data voltages to the amplifier circuits AB1 to AB6, the first latch circuit 131, which outputs display data to the D/A conversion circuit 133, and the second latch circuit 132, which latches received display data and outputs it to the first latch circuit 131.

In the scanner drive system, it is not necessary to latch display data of one line into the first latch circuit 131 and the second latch circuit 132, and thus it is impossible to monitor the display data of one line and determine whether or not the display line is a black display line. In this embodiment, to solve the problem, the determination information is received from the external device 110 and whether or not the display line is a black display line can be determined.

More specifically, during a k-th period (k is an integer one or more and m or less) in a first to m-th periods (m is an integer two or more) in a horizontal scanning period, the first latch circuit 131 latches first data of n pixels corresponding to a block and the second latch circuit 132 latches second data, which is a next data of the first data) of n pixels (n is an integer two or more) corresponding to a block, where n is a number less than the number of pixels in one line.

In FIG. 3, a period during which the first latch circuit 131 is latching display data DAk (first data) as display data DATAX corresponds to a k-th period. In the k-th period, the second latch circuit 132 latches display data DAk+1 (second data). Each of the display data DAk and the display data DAk+1 is display data of 6(n) pixels corresponding to a block of the data line. In the scanner drive system, the blocks are sequentially driven, and in the driving order, the order corresponding to the display data DAk+1 is a next order of the order corresponding to the display data DAk.

As described above, in the scanner drive system, display data of one block (n pixels) is latched at a time. According to the system, only the display data of one block (n pixels) is latched and it is not possible to determine in accordance with the latched display data whether or not the display line is a black display line. In this embodiment, to solve the problem, the determination information is received from the external device 110 and whether or not the display line is a black display line can be determined.

Furthermore, in this embodiment, in the k-th period, the drive circuit 130 drives n pixels corresponding to a block based on the first data.

Specifically, in the k-th period, the first data (DAk) is latched by the first latch circuit 131 and n pixels are driven based on the first data, and in the next k+1-th period, the second data (DAk+1) is latched by the first latch circuit 131 and the next n pixels are driven based on the second data.

In such a manner, the first latch circuit 131 sequentially latches the display data of n pixels and the display line is driven n pixels at a time based on the display data of n pixels. Accordingly, the first latch circuit 131 stores only the display data of n pixels. Even in such a scanner drive system, according to the embodiment, it is possible to determine whether or not a display line is a black display line.

Figure 7:
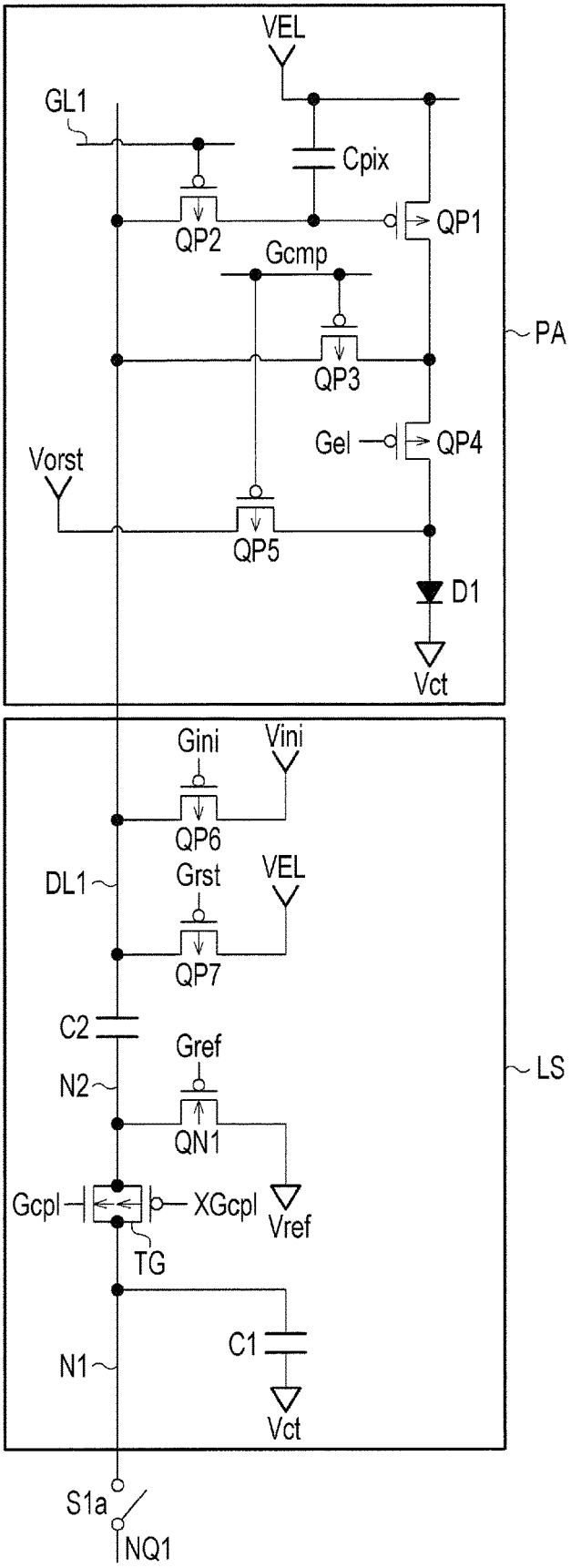
FIG. 7 illustrates a pixel circuit in detail.

In this embodiment, the pixel circuit PA in the pixel circuit array 150 includes a transistor (a transistor QP1 in FIG. 7) for supplying an electric current to a pixel (a light emitting element D1 in FIG. 7). The control circuit 140 performs control for turning off the transistor (QP1) in the pixel circuit PA corresponding to a black display line in the drive period TDR (TZL) of the black display line.

Specifically, the control circuit 140 controls a level setting circuit LS in FIG. 7 to set a gate voltage of the transistor QP1 in the pixel circuit PA to a voltage for turning off the transistor QP1. In the example of the pixel circuit PA in FIG. 7, the gate voltage of the transistor QP1 in the pixel circuit PA is set to a power-supply voltage VEL.

With this configuration, the transistor supplies no electric current to the pixel corresponding to the black display line and thereby the pixel can be displayed in black (displayed in accordance with the zero data).

In this embodiment, the display apparatus 100 includes the gradation voltage generation circuit 170 for supplying gradation voltages to the drive circuit 130. The control circuit 140 sets the gradation voltage generation circuit 170 to the operation off state or the low power consumption state in the black-display-line drive period TDR (TZL).

In the operation off state of the gradation voltage generation circuit 170, the operation of the gradation voltage generation circuit 170 is turned off. For example, the operation off state is a state where the electric current flowing through the gradation voltage generation circuit 170 is turned off. For example, a switching element is provided between a ladder resistance and a power-supply node and by turning off the switching element, the electric current flowing through the gradation voltage generation circuit 170 can be turned off. In the low power consumption state of the gradation voltage generation circuit 170, the electric current flowing through the gradation voltage generation circuit 170 is reduced compared with the normal operation state. For example, the electric current flowing through the ladder resistance is reduced.

With this configuration, during the period in which the black display line is driven, not only the current consumption of the amplifier circuits but also the current consumption of the gradation voltage generation circuit can be reduced. Accordingly, the power consumption in the display apparatus can be further reduced.

3. Second Example Configuration

Figure 4:
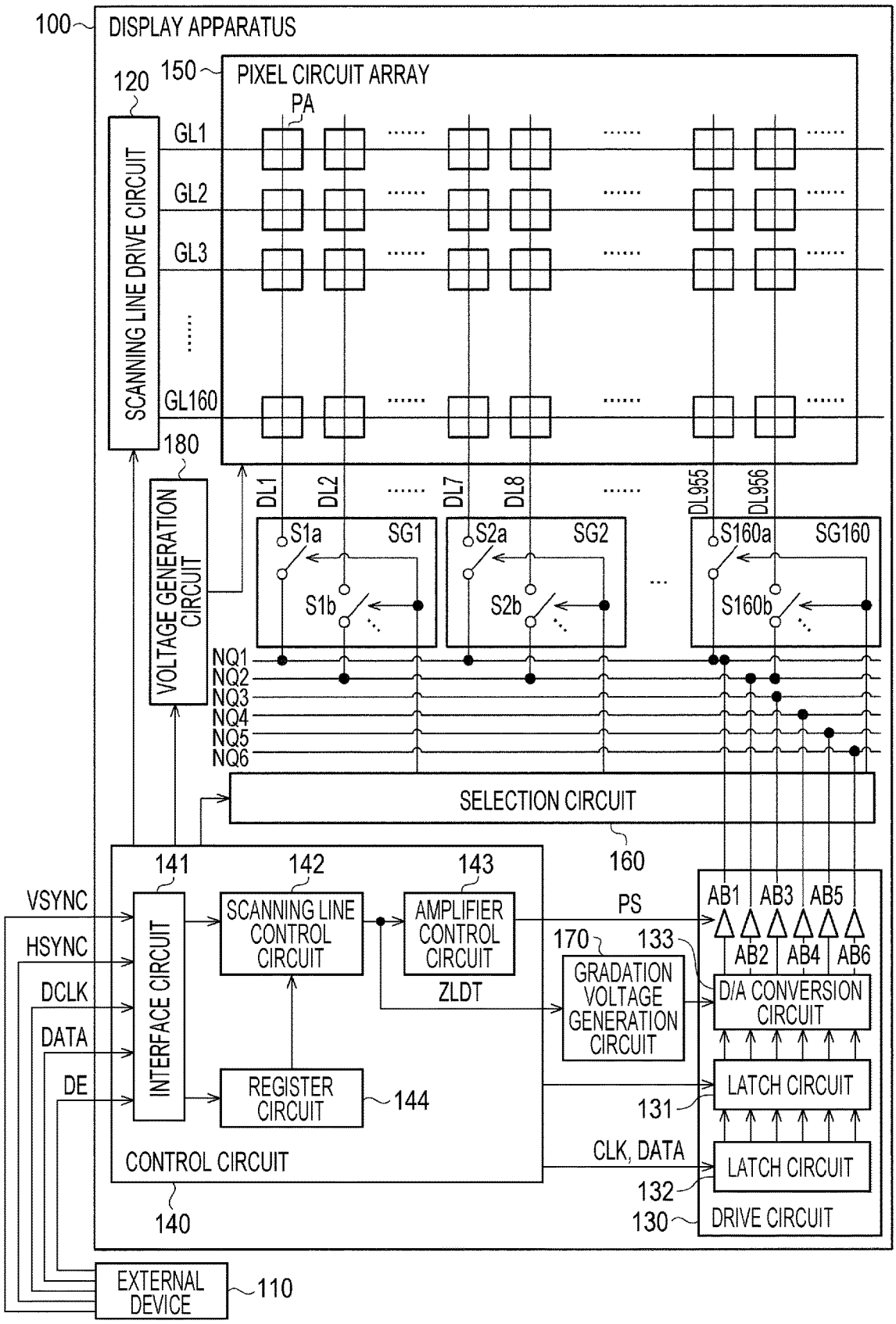
FIG. 4 illustrates a second configuration of the display apparatus according to the embodiment.

FIG. 4 illustrates a second configuration of the display apparatus according to the embodiment. In FIG. 4, the control circuit 140 includes a scanning line control circuit 142 and does not include the header detecting circuit 145. The same reference numerals are given to components similar to those in FIG. 2, and their descriptions will be omitted as appropriate. This embodiment is not limited to the configuration illustrated in FIG. 4, and various modifications may be made, for example, a part of the components may be omitted or other components may be added.

Figure 5:
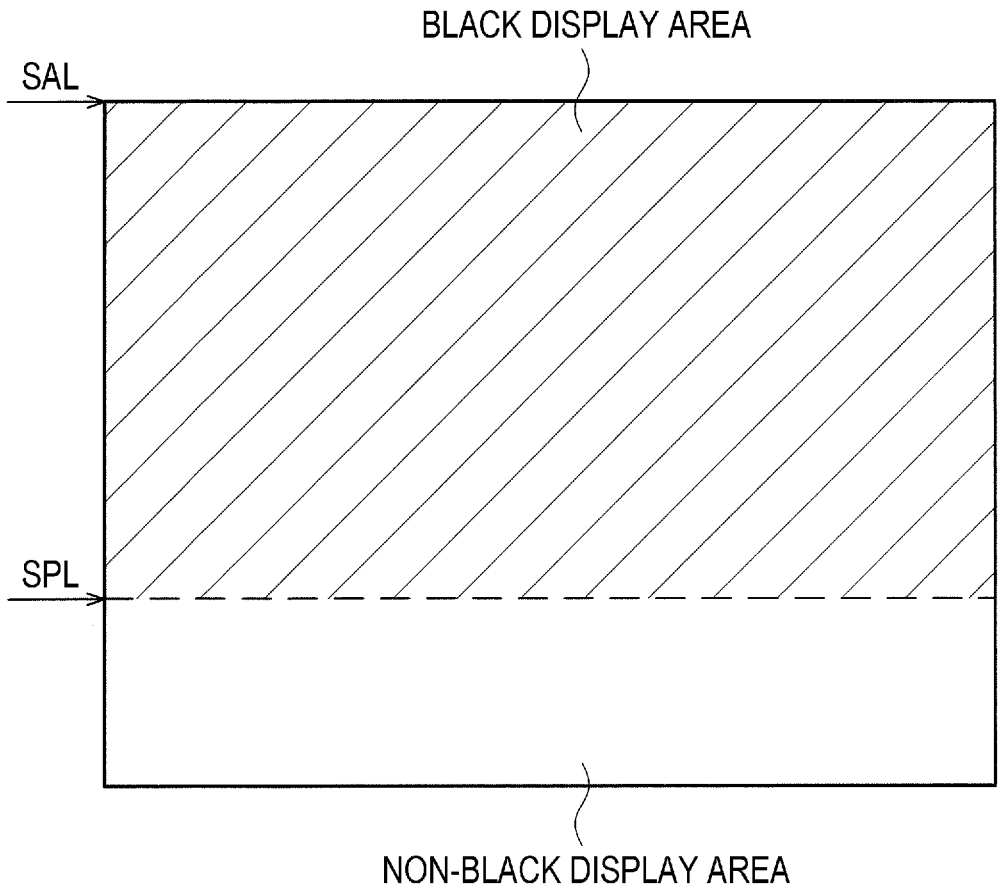
FIG. 5 is a schematic view of an image displayed on a pixel circuit array in the second configuration.

FIG. 5 is a schematic view of an image displayed on the pixel circuit array (display) in the second example configuration. The image includes a black display area and a non-black display area. The black display area is an area where the display data of the pixels in the area indicates zero data. The non-black display area is an area where the display data of the pixels in the area is not limited to zero data and characters, images, or the like can be displayed. Border lines (scanning lines) of a black display area are defined as a line SAL and a line SPL respectively. Between the lines SAL and SPL, a scanning line to be selected first in a vertical scanning period is defined as a start line SAL, and a scanning line to be selected later is defined as an end line SPL.

The register circuit 144 stores information about the start line SAL and information about the end line SPL. For example, the register circuit 144 stores a line number of each scanning line. The information is written in the register circuit 144 by the external device 110.

The scanning line control circuit 142 counts the number of falling edges of the horizontal synchronization signal HSYNC (the number of selected scanning lines) in a vertical scanning period. Based on the count value and the information about the start line SAL and the information about the end line SPL stored in the register circuit 144, the scanning line control circuit 142 determines whether or not the display line (the display line currently to be driven) is a display line between the start line SAL and the end line SPL. If the display line is a display line between the start line SAL and the end line SPL, the scanning line control circuit 142 sets the detection signal ZLDT to active and if the display line is not a display line between the start line SAL and the end line SPL, sets the detection signal ZLDT to inactive.

Figure 6:
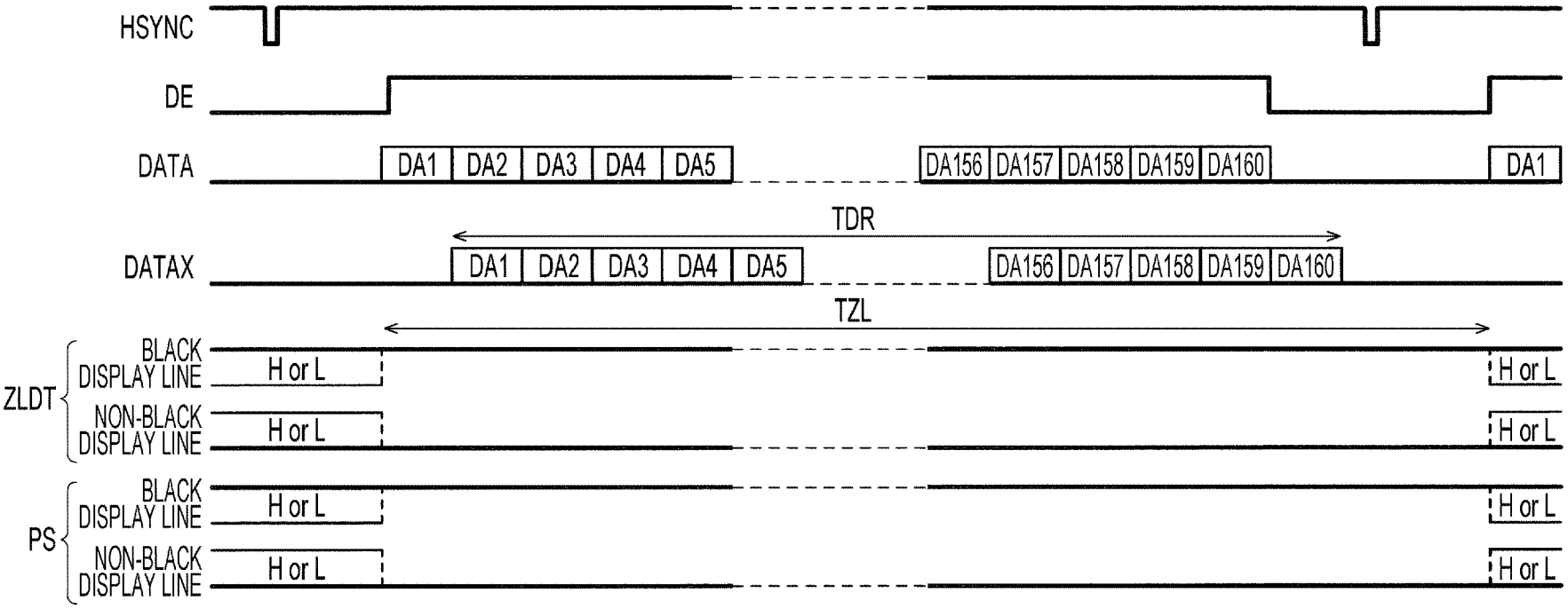
FIG. 6 is an operation timing chart of the display apparatus in the second configuration.

FIG. 6 is an operation timing chart of the display apparatus in the second configuration. The basic operation related to the scanner driving (the inputting of the display data DA1 to DA6, the writing of data to pixels based on the display data DA1 to DA6, and other operation) is similar to that in FIG. 3, and its description will be omitted.

In FIG. 6, no header information HDR as in FIG. 3 is added to the display data DATA. If a display line is a display line between the start line SAL and the end line SPL, the scanning line control circuit 142 outputs a high-level (active) detection signal ZLDT at a predetermined timing. If a display line is not a display line between the start line SAL and the end line SPL, the scanning line control circuit 142 outputs a low-level (inactive) detection signal ZLDT at a predetermined timing. The predetermined timing is, for example, a timing at which the input of the display data DA1 is started, that is, a timing at which the data enable signal DE is switched from inactive to active.

In the above-described second example configuration, the control circuit 140 receives a command indicating the start line SAL and the end line SPL of a black display area as the determination information.

Specifically, a black display is defined by one or more black display lines successively arranged in the vertical scanning direction. Although FIG. 5 illustrates a single black display area in the screen, a plurality of black display areas may exist within a screen. In such a case, the control circuit 140 receives a command indicating a start line and an end line of each black display area. The control circuit 140 analyzes (decodes) the received command and writes the information included in the command about the start line SAL and the information about the end line SPL to the register circuit 144. The timing for receiving the command (the timing for transmitting the command from the external device 110) can be various timings. For example, in a case where an application for displaying images or characters only on a part of the screen is to be executed, the display apparatus 100 receives a command corresponding to the application when starting the application or another timing. Alternatively, the display apparatus 100 may receive a command for every one frame (one image).

With this configuration, by receiving a command indicating the start line SAL and the end line SPL of a black display area, the information about the start line SAL and the end line SPL can be obtained. Based on the information about the start line SAL and the end line SPL, the black display line can be detected.

In this embodiment, the control circuit 140 sets the amplifier circuits AB1 to AB6 to the operation off state or the low power consumption state in the period (TDR in FIG. 6) in which the display lines from the start line SAL to the end line SPL are driven.

With this configuration, in the period in which the display lines constituting the black display area are driven, the current consumption of the amplifier circuits can be reduced. Accordingly, the power consumption in the display apparatus can be reduced.

4. Pixel Circuit

FIG. 7 illustrates a detailed example configuration of the pixel circuit. In the description below, an example pixel circuit that is connected to the data line DL1 and the scanning line GL1 will be described and other pixel circuits have similar configurations.

The pixel circuit PA includes p-type transistors QP1 to QP5, a capacitor Cpix, and a light emitting element (light emitting diode) D1. The gate of the transistor QP2 is connected to the scanning line GL1. A signal Gcmp is input to the gates of the transistors QP3 and QP5, and a signal Gel is input to the gate of the transistor QP4. The signals Gcmp and Gel are supplied from the scanning line drive circuit 120.

The level setting circuit LS is provided between a switching element S1*a* and the data line DL1. The level setting circuit LS is not shown in FIG. 2 and FIG. 4. The level setting circuit LS includes p-type transistors QP6 and QP7, an n-type transistor QN1, capacitors C1 and C2, and a transfer gate TG. A signal Gini is input to the gate of the transistor QP6, a signal Grst is input to the gate of the transistor QP7, and a signal Gref is input to the gate of the transistor QN1. The transfer gate TG includes a p-type transistor and an n-type transistor. A signal XGcpl is input to the gate of the p-type transistor, and a signal Gcpl is input to the gate of the n-type transistor. The signals Grst and Gref are generated based on the detection signal ZLDT in FIG. 2 or FIG. 4 and supplied from the header detecting circuit 145 or the scanning line control circuit 142 in the control circuit 140. The signals Gini, XGcpl, and Gcpl are supplied from the control circuit 140.

Hereinafter, an operation to be performed in a case where the pixel circuit PA is not a pixel circuit of a black display line is described. In an initial state, the transistors QP2, QP3, QP5, QP6, QP7, and QN1, and the transfer gate TG are turned off, and the transistor QP4 is turned on.

After a horizontal scanning period has started, the switching element S1*a* is turned on at a predetermined timing, the capacitor C1 is charged with the data voltage from the amplifier circuit AB1 and the node N1 at one end of the capacitor C1 becomes to have the data voltage. The other end of the capacitor C1 is connected to a node of a power-supply voltage Vct.

Then, the transfer gate TG is turned on and the data voltage charged in the capacitor C1 is applied to the data line DL1 via the capacitor C2. Prior to the application, the transistors QP6 and QN1 have been turned on, a node N2 at one end of the capacitor C2 has been set to the voltage Vref, and the data line DL1 has been set to an initialization voltage Vini. Then, the transistors QP4 and QP6 are turned off. Then, the transistor QP5 is turned on, the anode of the light emitting element D1 is set to a voltage Vorst, and the light emitting element D1 is reset. After the transistors QP4 and QP6 have been turned off, the transistors QP2 and QP3 are turned on, and the gate and the drain of the transistor QP1 are connected. In this state, the data line DL1 is connected to the gate of the transistor QP1. The source of the transistor QP1 is connected to a node of the power-supply voltage VEL. With this connection, the gate voltage of the transistor QP1 and the voltage of the data line DL1 are set to a predetermined value (a voltage for compensating for variations in the threshold voltage of the transistor QP1). The predetermined value has been set correspondingly to the threshold voltage of the transistor QP1. If the threshold voltages of the transistors QP1 in the pixels differ from each other, a different value is set to each pixel as a predetermined value. Then, the transistors QP3 and QP5 are turned off.

Then, the transfer gate TG is turned on and the data voltage charged in the capacitor C1 is applied to the capacitor C2. The voltage at the node N, which is one end of the capacitor C2, is changed from the voltage Vref to the data voltage, and a potential change corresponding to this difference also occurs in the data line DL1. Specifically, the voltage of the data line DL1 is set to a voltage obtained by superposing the potential change on the predetermined value (the voltage for compensating for variations in the threshold voltage of the transistor QP1). The voltage of the data line DL1 is determined by the charge redistribution of the capacitors C1, C2, and Cpix (and parasitic capacitance), and the voltage is held at the gate node of the transistor QP1 by the capacitor Cpix. One end of the capacitor Cpix is connected to the gate of the transistor QP1 and the other end is connected to a node of the power-supply voltage VEL. Then, the transistor QP2 and the transfer gate TG are turned off. The transistor QP1 supplies a drain current corresponding to the gate voltage held by the capacitor Cpix to the light emitting element D1.

Hereinafter, an operation to be performed when the pixel circuit PA is a pixel circuit of a black display line is described. In an initial state, the transistors QP2, QP3, QP5, QP6, QP7, and QN1, and the transfer gate TG are turned off, and the transistor QP4 is turned on.

After a horizontal scanning period has started, the detection signal ZLDT becomes active, the signals Grst and Gref become active, and the transistors QP7 and QN1 are turned on. The node N2 at one end of the capacitor C2 is set to the voltage Vref, and the data line DL1 connected to the other end of the capacitor C2 is set to the power-supply voltage VEL. Then, the transistor QP2 is turned on, and the power-supply voltage VEL is held at the gate node of the transistor QP1 by the capacitor Cpix. Then, the transistors QP2, QP7, and QN1 are turned off. The power-supply voltage VEL is set to the gate and source of the transistor QP1, and thereby the transistor QP1 is turned off and no electric current is supplied to the light emitting element D1. While the detected signal ZLDT (control signal PS) is active, the amplifier circuits AB1 to AB6 are set to the operation off state or the low power consumption state.

The operation to be performed when the pixel circuit PA is a pixel circuit of a black display line is not limited to the above-described example. For example, following modifications can be provided. For example, after a horizontal scanning period has started, the switching element S1*a* is turned on at a predetermined timing. The output node NQ1 of the amplifier circuit AB1 has been set to the voltage VRH to enable the capacitor C1 to hold the voltage VRH. In subsequent steps, operation similar to that in the case where the pixel circuit PA is not a black display line is performed to enable the capacitor Cpix to hold a voltage corresponding to the voltage VRH. The voltage VRH is a voltage for setting the data line DL1 to a voltage around the power-supply voltage VEL by charge redistribution of the capacitors C1, C2, and Cpix (and parasitic capacitance). With this configuration, at the gate node of the transistor QP1, the power-supply voltage VEL is held by the capacitor Cpix and the transistor QP1 is turned off.

In the above-described modification, the amplifier circuits AB1 to AB6 may be set to the operation off state or the low power consumption state for each block (six pixels) instead of each display line. For example, the control circuit 140 may include a determination circuit for determining whether or not display data of a block is zero data based on display data latched by the latch circuit 131. If the determination circuit determines that the display data of the block is zero data, the detection signal ZLDT is set to active.

5. Amplifier Circuit

Figure 8:
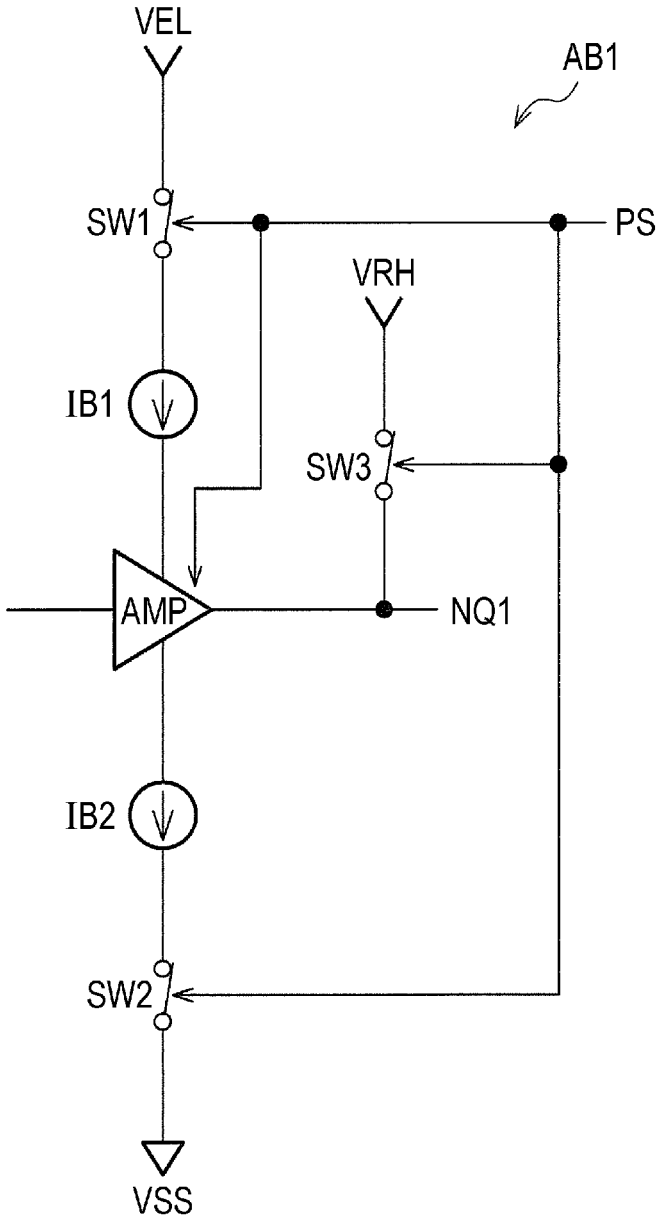
FIG. 8 illustrates an amplifier circuit in detail.

FIG. 8 illustrates a detailed example configuration of an amplifier circuit. In the following description, the amplifier circuit AB1 will be describes as an example, and the amplifier circuits AB2 to AB6 have similar configurations. The amplifier circuit AB1 includes switching elements SW1 to SW3, current source circuits IB1 and IB2, and an operational amplifier AMP.

The current source circuits IB1 and IB2 are circuits for passing bias currents through transistors of a differential pair of the operational amplifier AMP or a transistor of an output stage. For example, the current source circuit IB1 is a p-type transistor having a gate to which a bias voltage is input, and the current source circuit IB2 is an n-type transistor having a gate to which a bias voltage is input.

The switching element SW1 is provided between the current source circuit IB1 and a node of the high-potential power-supply voltage VEL. The switching element SW2 is provided between the current source circuit IB2 and a node of the low-potential power-supply voltage VSS. The switching element SW3 is provided between a node of the voltage VRH and the output node NQ1 of the operational amplifier AMP. Each of the switching elements SW1 to SW3 is a transistor.

When a black display line is detected and the control signal PS becomes active, the switching elements SW1 and SW2 are turned off, the switching element SW3 is turned on, and an output of the operational amplifier AMP becomes a high-impedance state. When the switching elements SW1 and SW2 are turned off, the current paths of the current source circuits IB1 and IB2 are interrupted, and no bias current is supplied to the operational amplifier AMP. Consequently, the power consumption can be reduced. When the switching element SW3 is turned on and the output of the operational amplifier AMP becomes the high-impedance state, the voltage of the output node NQ1 is set to the voltage VRH. For example, a switching element (transistor) is provided between the transistor of the output stage of the operational amplifier AMP and a power-supply node, and the switching element is turned off to set the output of the operational amplifier AMP to the high-impedance state. If the control signal PS is inactive, the switching elements SW1 and SW2 are turned on, the switching element SW3 is turned off, and the operational amplifier AMP becomes a signal output state.

6. Electronic Apparatus

Figure 9:
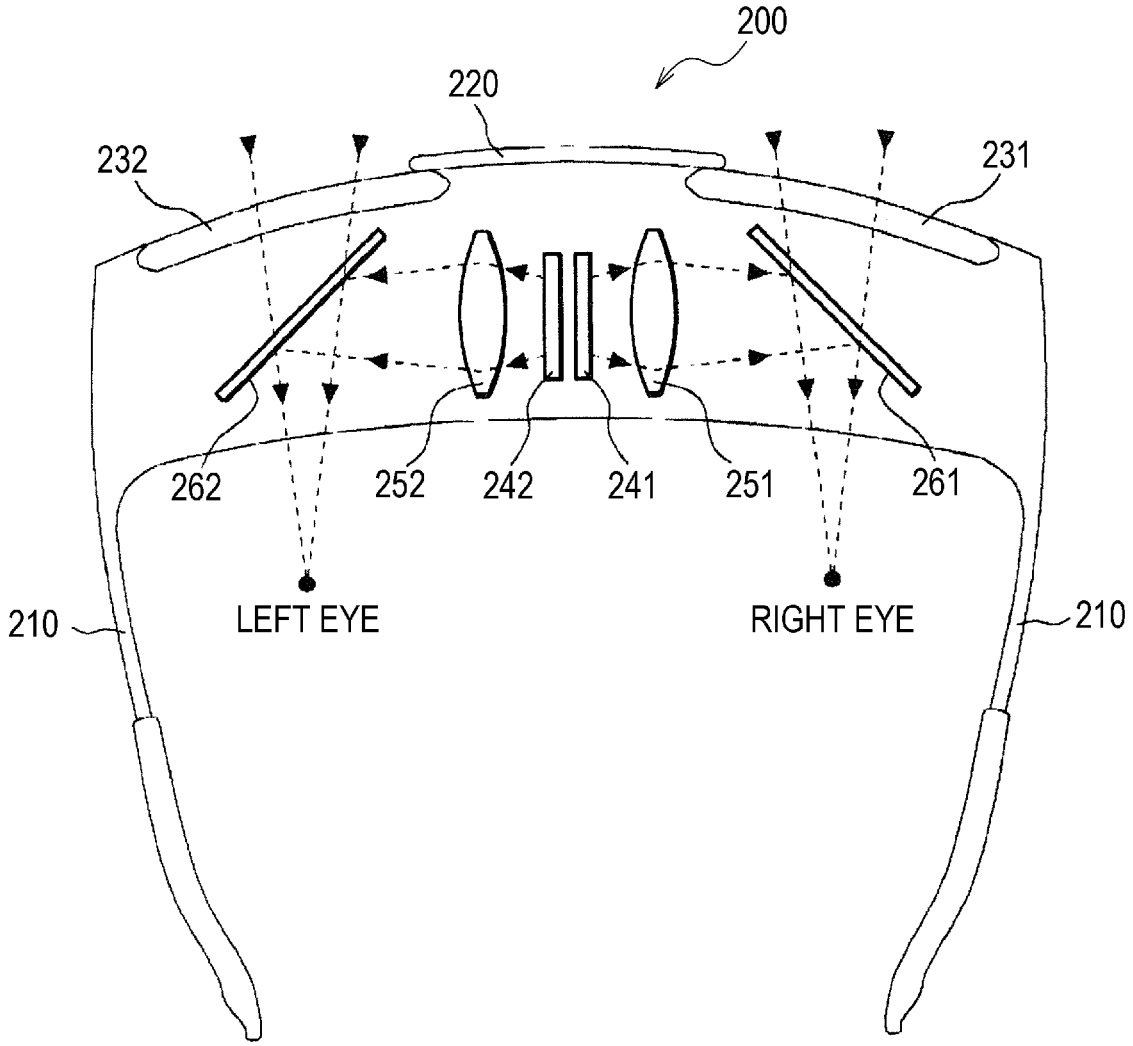
FIG. 9 illustrates an electronic apparatus in a first structure.

FIG. 9 illustrates a first structure of an electronic apparatus that includes a display apparatus according to the embodiment. FIG. 9 illustrates an example head-mounted display as an example of the electronic apparatus.

A head-mounted display 200 includes a temple 210, which is used to mount the head-mounted display on the head, a right-eye lens 231, a left-eye lens 232, and a bridge 220, which is provided between the lens 231 and the lens 232.

The head-mounted display 200 also includes display devices 241 and 242, lends 251 and 252, and half mirrors 261 and 262. Each of the display apparatuses 241 and 242 corresponds to the display apparatus 100 in FIG. 2 or FIG. 4. The light emitted from the pixel circuit array of the display apparatus 241 enters the half mirror 261 through the lens 251 and is reflected by the half mirror 261 toward the right eye. The light incident on the half mirror 261 through the lens 231 passes through the half mirror 261 and enters the right eye. Similarly, the light emitted from the pixel circuit array of the display apparatus 242 enters the half mirror 262 through the lens 252 and reflected by the half mirror 262 toward the left eye. The light incident on the half mirror 262 through the lens 232 passes through the half mirror 262 and enters the left eye. With this structure, the images displayed on the display apparatuses 241 and 242 are superimposed on the external scenery and observed in the see-through state.

The head-mounted display according to the embodiment is not limited to this example. For example, the display apparatus may be applied to various electronic apparatuses described below.

Figure 10:
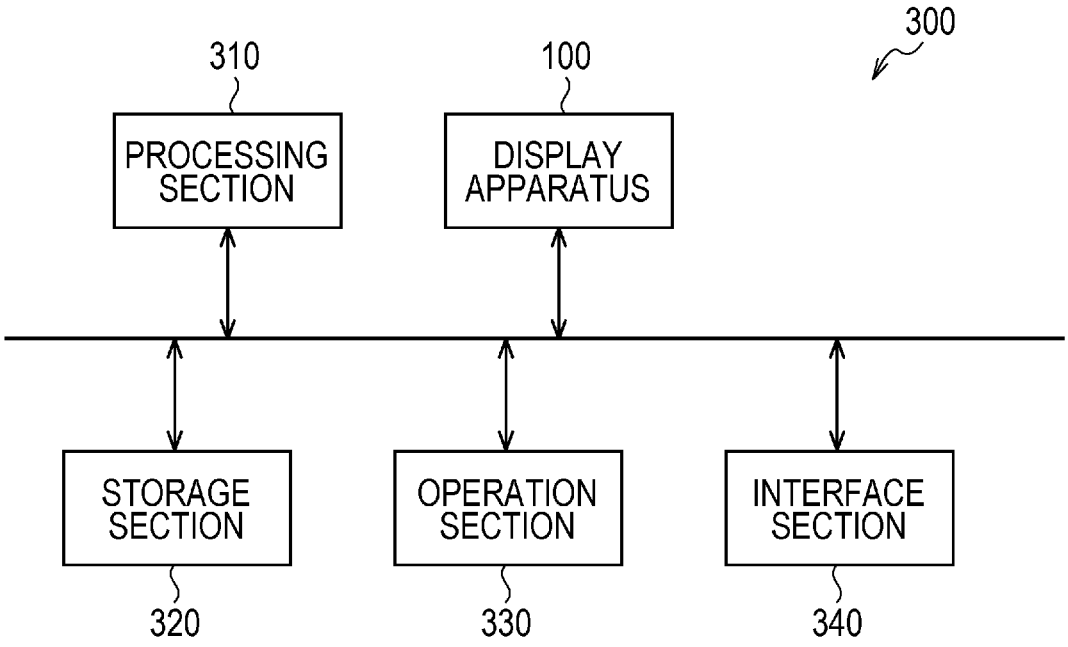
FIG. 10 illustrates an electronic apparatus in a second structure.

FIG. 10 illustrates a second structure of an electronic apparatus that includes a display apparatus according to the embodiment. Specifically, an electronic apparatus 300 may be, for example, various electronic apparatuses that are provided with a display apparatus, such as a personal digital assistant, an in-vehicle device, such as a meter panel, a car navigation system, or the like, a portable game terminal, an information processing device, or the like.

The electronic apparatus 300 includes a processing section 310, which is, for example, a processor such as a central processing unit (CPU) or a gate array, a storage section 320, such as a memory or a hard disk, an operation section 330, such as an operation device, an interface section 340, such as an interface circuit or an interface device, and the display apparatus 100, such as a display.

The operation section 330 is a user interface that receives various operations from users. For example, the operation section 330 is a button, a mouse, a keyboard, or a touch panel that is attached to a display section 350. The interface section 340 is a data interface that inputs or outputs image data or control data. For example, the interface section 340 is a wired communication interface such as a universal serial bus (USB) or a wireless communication interface such as a wireless local area network (LAN). The storage section 320 stores data input from the interface section 340. Alternatively, the storage section 320 serves as a working memory of the processing section 310. The processing section 310 processes display data that has been input from the interface section 340 or stored in the storage section 320 and transfers the processed data to the display apparatus 100. The display apparatus 100 displays an image on the pixel circuit array in accordance with the display data transferred from the processing section 310.

Although the embodiments have been described in detail above, a person skilled in the art will readily understand that various modifications can be made without departing from the scope of the invention. Consequently, all modifications are included within the scope of the invention. For example, in the specification or drawings, terms used at least once together with broader or equivalent different terms can be replaced with the different terms at any point in the specification or drawings. Furthermore, any combination of the embodiments and modifications is included in the scope of the invention.

The entire disclosure of Japanese Patent Application No. 2017-043494, filed Mar. 8, 2017 is expressly incorporated by reference herein.

What is claimed is:

1. A display apparatus comprising:

at least a pixel circuit array, a drive circuit, and a control circuit mounted on a same semiconductor substrate, the pixel circuit array being provided with a plurality of data lines and a plurality of columns of pixel circuits, and each data line corresponding to a column of the pixel circuits, and the drive circuit comprising:

a plurality of amplifier circuits, a number of the amplifier circuits being less than a number of the data lines corresponding to the columns of pixels circuits;

a plurality of latch circuits configured to latch display data for a plurality of pixels, a number of the pixels being equal to the number of amplifier circuits; and a digital-to-analog (D/A) conversion circuit configured to convert the display data latched in the latch circuits into a plurality of data voltages, the D/A conversion circuit having a number of outputs that equals the number of the amplifier circuits, wherein the control circuit is configured to control the drive circuit and receive determination information for determining whether or not a display line corresponding to display data is a black display line, wherein the drive circuit drives a group of the data lines, which are selected in sequence out of the plurality of data lines corresponding to the columns of pixels circuits in one of a plurality of predetermined periods in one horizontal synchronization period, the group of the selected data lines including a number of data lines that is equal to the number of amplifier circuits, and wherein the control circuit sets the plurality of amplifier circuits to an operation off state or a low power consumption state based on the determination information.

2. The display apparatus according to claim 1, wherein the control circuit receives the determination information included in header information of the display data corresponding to the display line.

3. The display apparatus according to claim 2, wherein if the control circuit determines that the display line corresponding to the header information is the black display line based on the determination information included in the header information, the control circuit sets the amplifier circuits to the operation off state or the low power consumption state during the period in which the display line is driven.

4. The display apparatus according to claim 1, wherein the control circuit receives a command indicating a start line and an end line of a black display area as the determination information.

5. The display apparatus according to claim 4, wherein the control circuit sets the amplifier circuits to the operation off state or the low power consumption state during the period in which the display lines from the start line to the end lines are driven.

6. The display apparatus according to claim 1, wherein the pixel circuit included in the pixel circuit array includes a transistor for supplying an electric current to a pixel, and the control circuit turns off the transistor in the pixel circuit corresponding to the black display line during the period in which the black display line is driven.

7. The display apparatus according to claim 1, further comprising:

a gradation voltage generation circuit configured to supply gradation voltage to the drive circuit, wherein the control circuit sets the gradation voltage generation circuit to an operation off state or a low power consumption state during a period in which the black line is driven.

8. An electronic apparatus comprising the display apparatus according to claim 1.

9. An electronic apparatus comprising the display apparatus according to claim 2.

10. An electronic apparatus comprising the display apparatus according to claim 3.

11. An electronic apparatus comprising the display apparatus according to claim 4.

12. An electronic apparatus comprising the display apparatus according to claim 5.

13. An electronic apparatus comprising the display apparatus according to claim 6.

14. An electronic apparatus comprising the display apparatus according to claim 7.

15. A display apparatus comprising:

a pixel circuit array;

a drive circuit configured to sequentially drive each of a plurality of blocks of data line groups in the pixel circuit array;

a control circuit configured to control the drive circuit; and a gradation voltage generation circuit configured to supply gradation voltages to the drive circuit, wherein the drive circuit includes:

a plurality of amplifier circuits, a number of the amplifier circuits being equal to a number of data lines in one block, of the plurality of blocks;

a plurality of latch circuits including a first latch circuit configured to latch display data for each of the blocks and a second latch circuit configured to latch the display data output from the first latch circuit; and a digital-to-analog (D/A) conversion circuit configured to convert the display data latched in the latch circuits into a plurality of data voltages, the D/A conversion circuit having a number of outputs that equals the number of data lines in one block, wherein the drive circuit drives the data lines in the one block, which are selected in sequence out of the plurality of blocks in one of a plurality of predetermined periods in one horizontal synchronization period, wherein the control circuit receives determination information for determining whether or not a display line corresponding to display data is a black display line, and based on the determination information, sets the amplifier circuits to an operation off state or a low power consumption state during a period in which the black display line is driven, and wherein the control circuit sets the gradation voltage generation circuit to an operation off state or a low power consumption state during the period in which the black line is driven.

16. An electronic apparatus comprising the display apparatus according to claim 15.

17. The display apparatus according to claim 15, wherein the control circuit receives the determination information included in header information of the display data corresponding to the display data.

18. The display apparatus according to claim 17, wherein if the control circuit determines that the display line corresponding to the header information is the black display line based on the determination information included in the header information, the control circuit sets the amplifier circuits to the operation off state or the low power consumption state during the period in which the display line is driven.

* * * * *